US005644893A

United States Patent [19]

Neighbours

[11] Patent Number: 5,644,893

[45] Date of Patent: Jul. 8, 1997

[54] METHOD AND APPARATUS FOR CONSTRUCTING MULTI-STOREY BUILDINGS

[76] Inventor: Gregory John Neighbours, 24 Thorn Street, Edgecliff, NSW 2025, Australia

[21] Appl. No.: 244,340

[22] PCT Filed: Nov. 30, 1992

[86] PCT No.: PCT/AU92/00643

§ 371 Date: Aug. 18, 1994

§ 102(e) Date: Aug. 18, 1994

[87] PCT Pub. No.: WO95/11315

PCT Pub. Date: Jun. 10, 1993

[30] Foreign Application Priority Data

Nov. 29, 1991 [AU] Australia ..... PK9756
Aug. 27, 1992 [AU] Australia ..... PL4371

[51] Int. Cl.[6] ..... E04B 1/35

[52] U.S. Cl. ..... 52/745.19; 52/741.2; 52/125.1

[58] Field of Search ..... 52/125.1, 745.19, 52/745.2, 741.1

[56] References Cited

U.S. PATENT DOCUMENTS

| | | | |
|---|---|---|---|
| 1,066,436 | 7/1913 | Peltzer | 52/125.1 |
| 2,867,111 | 1/1959 | Youtz | 52/125.1 |
| 3,028,707 | 4/1962 | Sagalovitch | 52/125.1 X |
| 3,036,816 | 5/1962 | Stubbs et al. | 52/125.1 |
| 3,065,573 | 11/1962 | Goldberg | 52/125.1 |
| 3,194,532 | 7/1965 | Harrill | 249/39 X |
| 3,579,935 | 5/1971 | Regan | 52/125.1 |

FOREIGN PATENT DOCUMENTS

| | | |
|---|---|---|
| 0017678 | 8/1968 | Australia . |
| 0049611 | 7/1970 | Australia . |
| 2511999 | 9/1976 | Germany . |
| 1041079 | 9/1966 | United Kingdom . |
| WO8808903 | 12/1988 | WIPO . |

*Primary Examiner*—Carl D. Friedman
*Assistant Examiner*—Winnie Yip
*Attorney, Agent, or Firm*—Knobbe, Martens, Olson & Bear, LLP

[57] ABSTRACT

A method and apparatus for constructing a multi-storey building. A first slab (22) is formed directly on top of a second slab (21). The slab (22) is formed with a plurality of apertures spread about the slab area. A plurality of extendible prop means (10) are positioned in the respective apertures, the head portion (12) of each prop means being connected to the first slab (22), the foot portion (13) of each prop means being supported by a slab below the first slab (22). The prop means (10) is extended such that the first slab (22) is lifted to its desired position. Once in that desired position, the foot portion (13) of each extended prop means is retracted through its respective aperture to engage the upper surface of the first slab (22) and the process is repeated according to the number of storeys required in the building.

16 Claims, 4 Drawing Sheets

METHOD AND APPARATUS FOR CONSTRUCTING MULTI-STOREY BUILDINGS

TECHNICAL FIELD

The present invention relates to an improved building construction method and apparatus therefor and, more particularly, a method and apparatus for constructing multi-storey buildings.

BACKGROUND ART

Multi-storey buildings may be constructed by several techniques using several different types of material eg. structural steel, reinforced concrete either in situ or precast or any combination thereof. The builder may be required to construct or erect the structure including beams, columns, slabs and walls etc. as a whole or one level at a time. If the building is to be constructed one level at a time, each level may be constructed at its final floor to floor distance using conventional or proprietary formwork methods or for example with a structural steel frame building, each structural element would be lifted into place by a crane.

The use of a crane to lift main elements of the structure into place on a building may cause these operations lie directly on the critical path of the building programme. In other words, the speed of construction may be limited by the performance of the lifting crane.

Slabs, walls etc may be formed in-situ but the use of formwork to support in-situ concrete slabs requires substantial labour and materials. The handling and movement of formwork materials from floor to floor is also labour intensive and occupies excessive time on site. If a crane is used to lift or move these formwork materials, the time available for the crane to lift the other structural elements of the building is reduced.

Wall form building systems, such as slip form, also require their own lifting apparatus.

Another method of multi-storey building construction is known as "lift-slab". This method uses a floor slab surface as a soffitt to form another slab. The slab is formed by pouring directly on top of the lower slab. Proprietary material may be used to prevent the two slabs sticking together. Any number of floors and an equal number of columns in height may be cast one on top of each other. Using a lifting apparatus positioned and anchored on top of each column, each slab is then lifted into place starting with the last poured slab. Each slab is connected to the column of the building prior to the slab below being lifted.

Such a method requires the slabs to be formed with openings through which the column may slide-to allow movement of a slab to its final desired position. It is necessary, however, in the "lift-slab" method for each concrete slab to be fully cured prior to lifting. Clearly substantial time may be wasted waiting for curing of each slab prior to lifting.

These prior art methods all require substantial lifting apparatus such as cranes etc. and structural formwork to lift and position each slab, as well as continued incremental movement of these elements to each new floor level. Considerable time and expense is incurred in dismantling each set of formwork from one floor and moving it to the next floor for re-assembly.

In an effort to ameliorate the disadvantages of the prior art, therefore, it is proposed to provide a building construction method and apparatus which offers a choice over the prior art and which, at least in the preferred embodiments, is less expensive and time consuming as compared to the above mentioned prior art methods.

DISCLOSURE OF THE INVENTION

According to a first broad aspect, the present invention provides a method for constructing a multi-storey building comprising the steps of:

i) providing a plurality of extendible prop means having a head portion, a foot portion and an extendible portion stretching therebetween;

ii) forming a first floor/ceiling slab with a plurality of apertures therethrough spread about the slab area;

iii) connecting said first slab to a plurality of said extendible prop means positioned in respective apertures each head portion being positioned above and connected to said first slab, said extendible portion of each said prop means projecting downwardly through respective apertures whereby each said foot portion is supported by a second slab below said first slab;

iv) extending said extendible portion of said prop means to lift said first slab to a desired position; and v) retracting said extendible portion of each extended prop means through its respective aperture to detach said foot portion from said second slab;

vi) engaging said foot portion with a subsequent slab at least one floor height above said second slab.

In a further embodiment, a multi-storey building may be constructed by repeating steps (ii) to (iv) according to the number of storeys required.

In another embodiment, said second slab is directly below said first slab and said first slab is formed directly on top of said second slab.

In a further embodiment, said head portion is connected to said first slab by a suspension means, which may comprise chains or slings, extending from either side of the head portion to the first slab.

In yet another embodiment the plurality of prop means are extended in unison. It is also possible to extend a number of prop means adjacent an edge of said first slab prior to extending the remaining props in order to peel the first slab away from the second slab.

In still another embodiment, after the first slab is lifted to its desired position, it is held in that position by back props extending between the first and second slabs or by connection of the first slab to a support member of the building such as a column or wall.

It is also possible according to the present inventive method that prior to retraction of the extendible portion, at least the head portion of each prop means is held stationary relative to said first slab.

In yet a further embodiment, the extendible portion comprises a telescopic portion receivable within the head portion. The prop means may be extendible by any appropriate mechanism eg. mechanical, hydraulic, electrical or manual.

In still a further embodiment, after said first slab is in its desired position, slab edge formwork connected to said prop means is raised by one slab thickness in readiness for forming a subsequent slab.

In another broader aspect the present invention provides an apparatus for constructing a multi-storey building wherein an $n^{th}$ floor slab comprising a plurality of apertures spaced apart over the slab area is formed on and lifted from an $(n-1)^{th}$ floor slab, n being the number of the floor level under construction, said apparatus comprising a plurality of prop means spread adapted to be spaced apart over a slab area, each prop means comprising a head portion, a foot portion and an extendible portion therebetween, said head portion being adapted for connection to the $n^{th}$ floor slab, each said extendible portion being adapted to project through a respective aperture formed in the $n^{th}$ floor slab, to said foot portion, said foot portion being adapted for release engagement with a floor slab below said $n^{th}$ floor slab, such that upon extension of said extendible portion in use, said $n^{th}$ floor slab is lifted from said $(n-1)^{th}$ floor slab.

In a further embodiment, the foot portion of each prop means comprises a cup bearing. Such a cup bearing allows the prop means to tilt slightly from the vertical in response to tension on suspension means connecting the head portion to the slab, while maintaining reliable contact of the foot portion with the first slab. It is preferred that the cup bearing rests in a plate which covers an aperture formed in the slab supporting the foot portion.

The present invention provides a method and apparatus for constructing a multi-storey building in which repositioning of the scaffolding or formwork from floor to floor is substantially reduced. The various floor/ceiling slabs are lifted into place by means of a plurality or extendible prop means which "climb" within the building as it is constructed.

As outlined above, each slab may be formed on and lifted from the slab directly below. For example, according to the present invention a second floor slab may be formed directly onto the first floor slab which is already in place and appropriate apertures formed in the second slab to receive the extendible prop means. The foot portion of each extendible prop means is supported on the first floor slab and the head portion of each extendible prop means positioned above and connected to the just poured second floor slab by appropriate suspension means eg. chains, slings etc. Once the second floor slab is partially cured, the extendible portion of each prop means is extended and the second floor slab lifted into its desired position one floor to height from the first floor slab.

Once in its desired position, the slab may be supported in that position by back props or by connection to an appropriate support structure on the building eg. column.

The foot portions of each extended prop means are then retracted upwardly by one floor level to engage the second floor slab. A third floor slab, with appropriate apertures, is then formed directly on top of the second floor slab and the process repeated.

As will be understood by persons skilled in the art, each extendible prop means lifts each successive slab to its desired floor height/position in the building. Once in that position, the extendible prop means repositions itself to a floor slab above ready to repeat the process. There is no need for any repositioning of slab soffitt formwork or supports for lifting of the various slabs.

In addition, supporting a lifted slab or "back-propping" is a simple process of positioning appropriate back props underneath since the slab is held in the required position by the plurality of extendible prop means.

It is also possible, according to the present inventive method, to extend either individual prop means or groups of prop means in any desired configuration. This is particularly useful when separating a newly formed slab from the slab directly below.

As will be known to persons skilled in the art, when a new slab is formed, it is usual to have some form of release means ie. release compound, membrane etc. between the upper and lower slabs. If the slabs separate easily, the props may all be extended in unison to lift the newly formed slab. If, however, it is difficult to separate the newly formed slab from the existing slab appropriate control of the extension of each of the props may be required. For example, by actuating a slight extension in a small group of the inventive extendible props, an initial separation between the two slabs may be made and the remaining props may then be manipulated to "peel" the newly poured slab from the slab below. It is preferred to initiate such a "peeling" action from the edges of the slab, where separation appears to occur more easily at the edges.

BRIEF DESCRIPTION OF THE DRAWINGS

In order that the nature of the present invention may be more clearly understood, preferred embodiments of the invention will now be described, by way of example only, with reference to the accompanying drawings in which.

BEST MODE FOR CARRYING OUT THE INVENTION

Figure 1:
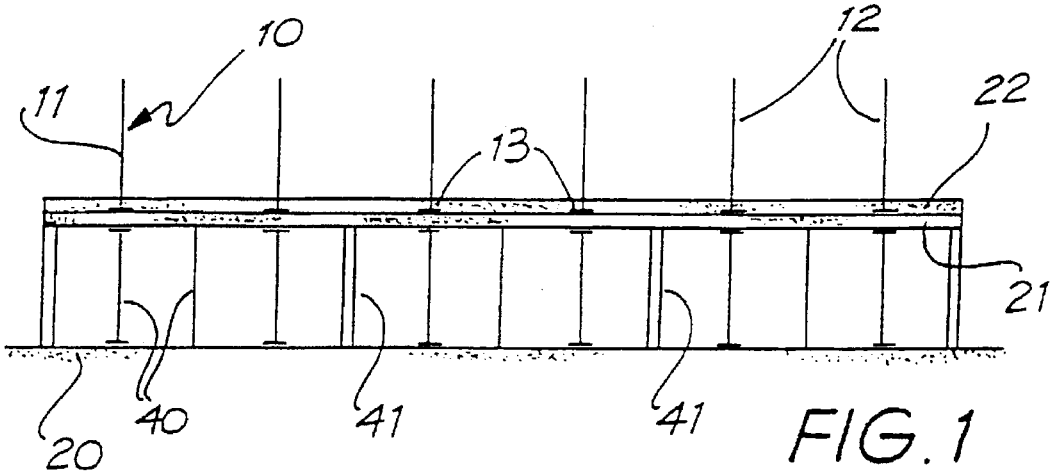
FIGS. 1–6 are side elevational views of a multi-storey building constructed in accordance with an embodiment of the present inventive method.

The building in FIG. 1 comprises a ground floor slab 20, the first floor slab 21 in its desired position one floor height above the ground floor and the second floor slab 22 newly poured directly onto first floor slab 21. The first floor slab 21 is supported by props 40, 41 evenly spread about the slab area.

Slab 22 is formed with a plurality of apertures therethrough. An extendible prop means 10 is positioned in each aperture for lifting slab 22 into its desired position, as will be explained below.

Figure 2:
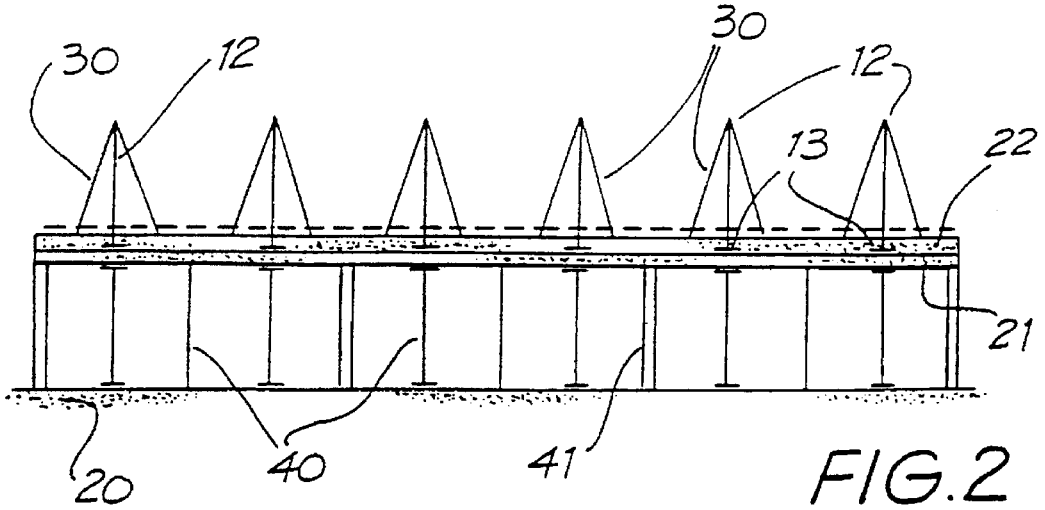

Each prop means 10 comprises a head portion 12 and a foot portion 13 with an extendible portion 11 therebetween. The head portion 12 of each prop means is positioned above and connected to slab 22 by suspension means 30, in this case chains or slings extending from either side head portion to positions on slab 22 spaced from the axis of prop means 10, however any appropriate connection may be used. For example, wings on tabs may extend outwardly from the prop means to engage the slab. Such wings on tabs, however, should be retractable to allow the retraction of extendible portion 11 through its respective aperture. Extendible portion 11 of each prop means 10 stretches from the head portion 12 downwardly through the respective aperture in slab 22 to foot portion 13 be supported on a slab 21 below slab 22. Foot portion 13 is sized to pass through the apertures formed in the various slabs. While FIGS. 1 and 2 show foot portion 13 supported on slab 21 directly below slab 22 to be lifted, extendible portion 11 may stretch downwardly through apertures formed in both slabs 21 and 22 with foot portion 13 being supported by ground floor slab 20.

Since foot portion 13 is supported by a floor slab below the slab to be lifted and head portion 12 is connected to slab 22, it will be understood that upon extension of extendible portion 11, the second floor slab will be lifted away from first floor slab 21. It is preferred that after the initial separation of the slabs the extension of prop means 10 occurs in unison to avoid buckling of the second floor slab 22 as it is lifted to its desired position one floor to ceiling distance above the first floor slab 21.

Figure 3:
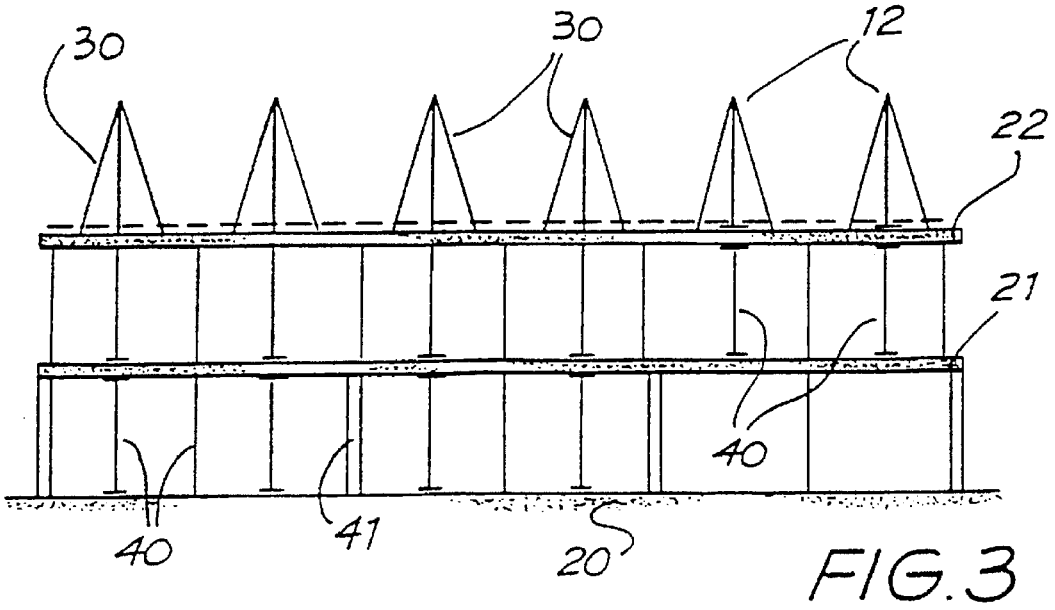
Figure 4:
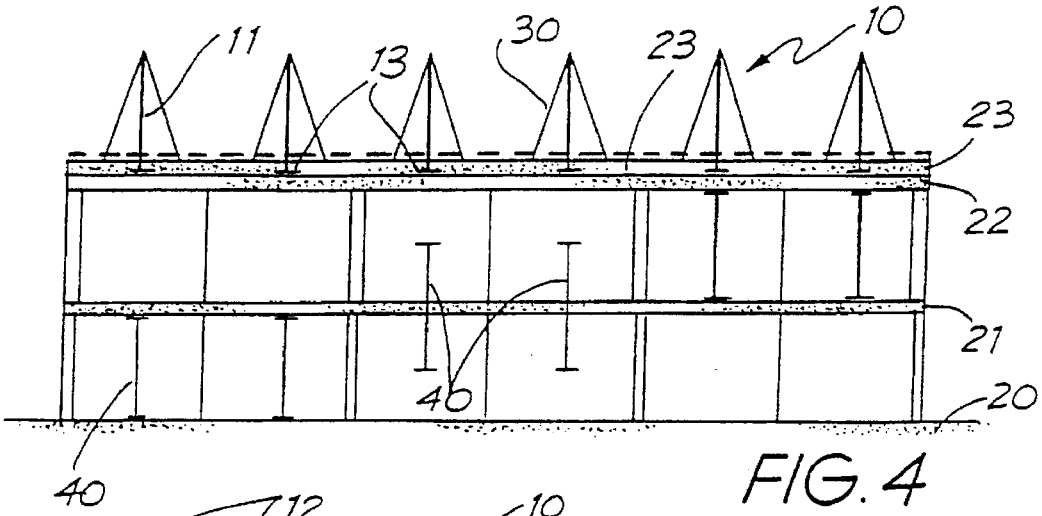

When in position, slab 22 may be supported by back props or supports 40, 41. The back props may be additional to those supporting first floor slab 22. Alternatively, supports 40, 41 from the first floor may be repositioned to support the second floor slab, as shown in FIGS. 3 and 4. Props 40, 41 may also pass through the apertures formed in slabs 21, 22 which allow at least foot portion 13 of each prop means 10 to pass through the slabs.

Once slab 22 is in position and supported by back props 40, 41, the foot portion 13 of each slab means may be retracted through the apertures in slab 22 to a position engaging the upper surface of the second floor slab 22 for subsequent lifting of a third floor slab 23 (see FIGS. 3 & 4). It will be understood that to assist in retraction of the prop means, at least the head portion 12 should be held stationary relative to the second floor 22, otherwise retraction of extendible prop means 10 may simply lower head portion 12 relative to the second floor slab 22.

It is also preferable to support the tops of the prop means 10 at this time to prevent toppling over the props during this retraction step.

As shown in FIG. 3, retraction of extendible portion 11 causes foot portion 13 to rise up through the aperture formed in second floor slab 22. If each foot portion 13 was supported by a ground floor slab 20, retraction of the prop means would cause foot portion 13 to rise up through apertures in the first floor slab 21 and rest on top of this first floor slab 21 in readiness for pouring of the third floor slab 23. In other words, it is within the realms of the present invention to position the foot portion 13 on any support slab which is below the slab to be lifted.

Prior to the third floor slab 23 being poured, the suspension means 30 is disconnected from the second floor slab 22 such that they do not become embedded in the newly poured third floor slab 23. Appropriate covers or barriers may also be positioned around prop means 10 or extendible portions 11 to prevent ingress of hardenable material onto or into the prop means 10 during pouring of the third floor slab 23.

It is also possible at this time to raise slab edge formwork connected to the prop means 10 in readiness for forming the third floor slab 23.

Figure 5:
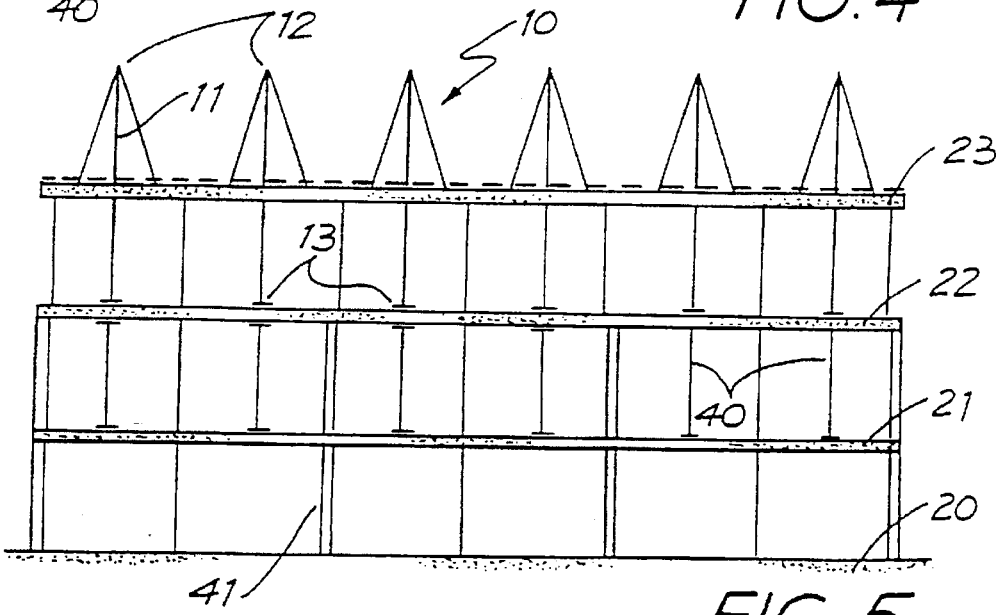

Once the third floor slab 23 has been poured, the suspension means 30 extending from head portions 12 are connected to slab 22 as shown in FIG. 4. Slab 23 is then lifted by extension of the various prop means 10, as shown in FIG. 5. Once again, when the third floor slab is in place and supported by appropriate back-propping, the foot portions 13 may be retracted upwardly through the third floor slab in readiness for lifting of the fourth floor slab 24, as shown in FIG. 6.

Extension and retraction of the extendible portion 11 may be accomplished by any appropriate manner, eg. mechanically, hydraulically etc.

It is also possible to provide, according to the present invention, a superstructure surrounding the building to which prop means 10 may be connected. In this way, the correct spatial relationship of the prop means 10 may be maintained and movement up the building may be guided to reduce lateral deviation of the prop means 10 and various slabs. Additionally, the drive means to extend the prop means 10 eg. hydraulics, electrics etc. may be incorporated in the superstructure and connected to the various prop means 10 spread about the slab area. The superstructure may also incorporate column, slab edge and wall formwork according to standard techniques, along with safety screens, operations room, working platforms, etc.

Figure 6:
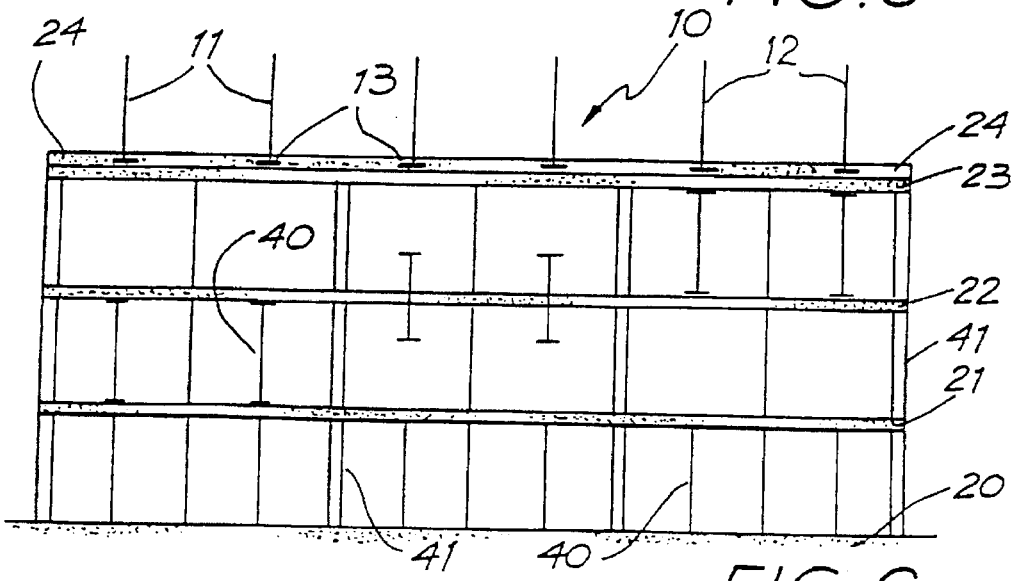

As it will be clear to a person skilled in the art, FIGS. 1–3 are essentially repeated by FIGS. 4–6 and will be further repeated for the number of storeys required in the building. All lifting of the slabs is accomplished by a plurality of prop means 10 spread about the slab area. The sequence of events may be summarized as, firstly pour a slab, secondly extend prop means to lift the slab, back prop or connect slab to building, retract prop means up one floor, repeat process. It should be noted that since prop means 10 climb the building with each newly constructed floor, there is no need to remove and reposition scaffolding from floor to floor. Further, if a super structure is attached to the prop means 10, it also rises with the prop means 10. The connection of column or other formwork to this "climbing" superstructure, therefore, allows simultaneous construction of other parts of the building as the super structure moves simultaneously upward with the prop means 10.

It should be noted that the present invention allows lifting of the various slabs prior to full curing of the slabs. Once a slab is in position, temporary support structures or back props 40, 41 support and stabilise the slab while it fully cures. During this curing stage, it is possible to connect the slab 32 to the remainder of the building. This connection with structural walls or columns of the building may be accomplished by means of connection plates or reinforcing steel extending from both the wall or column and the slab, this reinforcing steel overlapping in a previously formed void. The connection is then accomplished by filling the void with a hardenable material, such as concrete.

Another method of attaching the slab to the building is to use structural beams which are connected to the wall of the floor below. To explain, a slab is lifted to a position slightly higher than the final floor to ceiling height. Structural beams are then positioned by any appropriate means for example small electric fork lifts, and connected to the various walls. The slab is then lowered and connected to the structural beams. Such a method of attaching the slab to the building is safer and speedier than conventional methods of construction and allows all work to be carried out on a stable platform.

Figure 7:
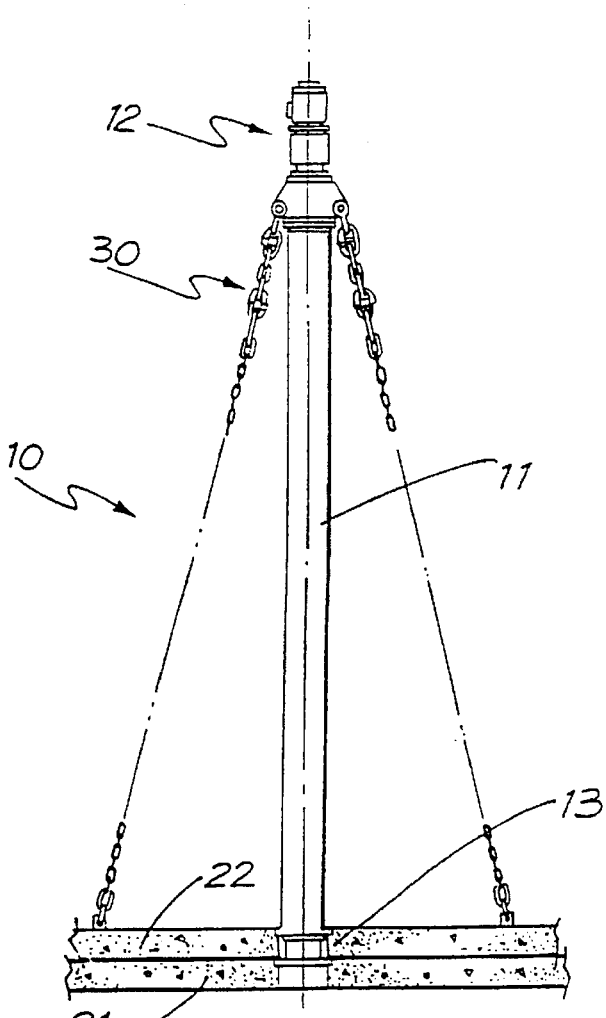
FIGS. 7–8 are side elevational views of an extendible prop means in the retracted and extended positions respectively, according to another embodiment of the present invention.
Figure 8:
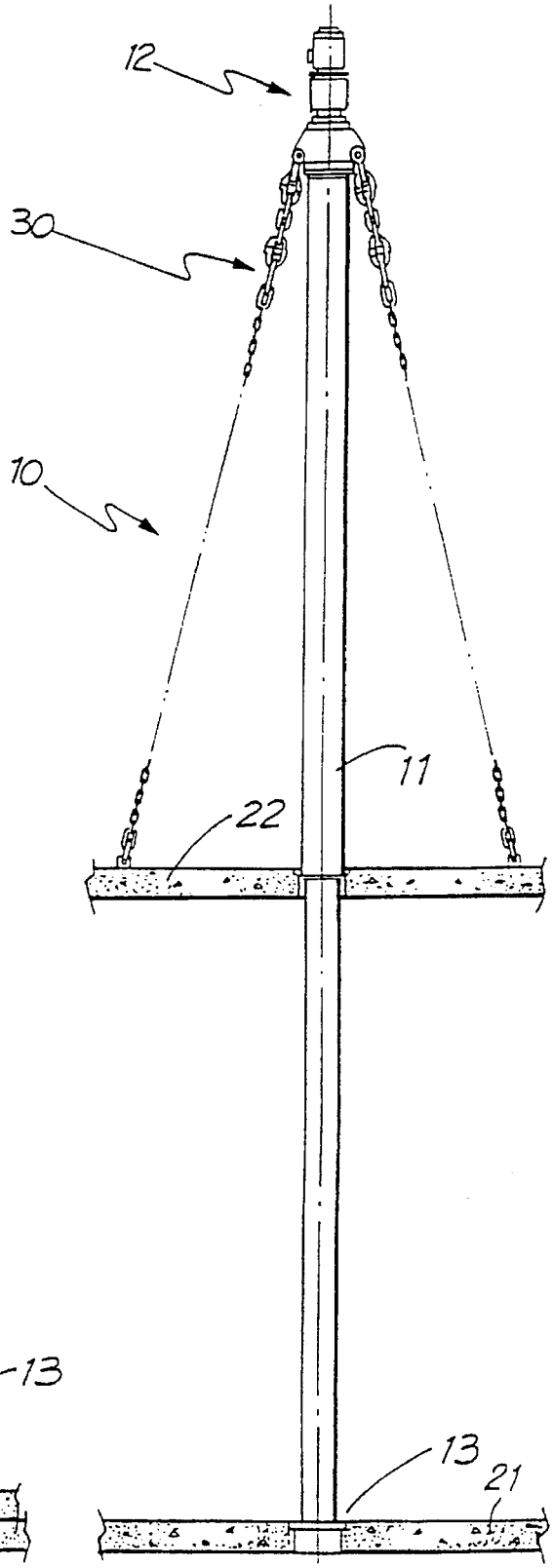

FIGS. 7–8 show an extendible prop means 10 according to the present invention. This prop means 10 comprises a head portion 12 and foot portion 13 with extendible portion 11 extending therebetween. Suspension means 30 in the form of chains or slings, extend between the head portion 12 and slab 22.

As also exemplified in FIGS. 1–6, FIG. 7 shows foot portion 13 of prop means 10 engaging slab 21 directly below the slab 22 to be lifted. To lift slab 22, prop means 10 is extended until all slack in the chains or slings 30 is taken up. Further extension of extendible prop means 10 lifts slab 22 until it reaches its desired position one floor to ceiling height above slab 21 as shown in FIG. 8. Once slab 22 is in position, it is supported by appropriate means eg. permanent or temporary back drops and foot portion 13 is retracted upwardly by one floor height to engage slab 22 so that the process may be repeated for positioning of the next floor slab.

Figure 9:
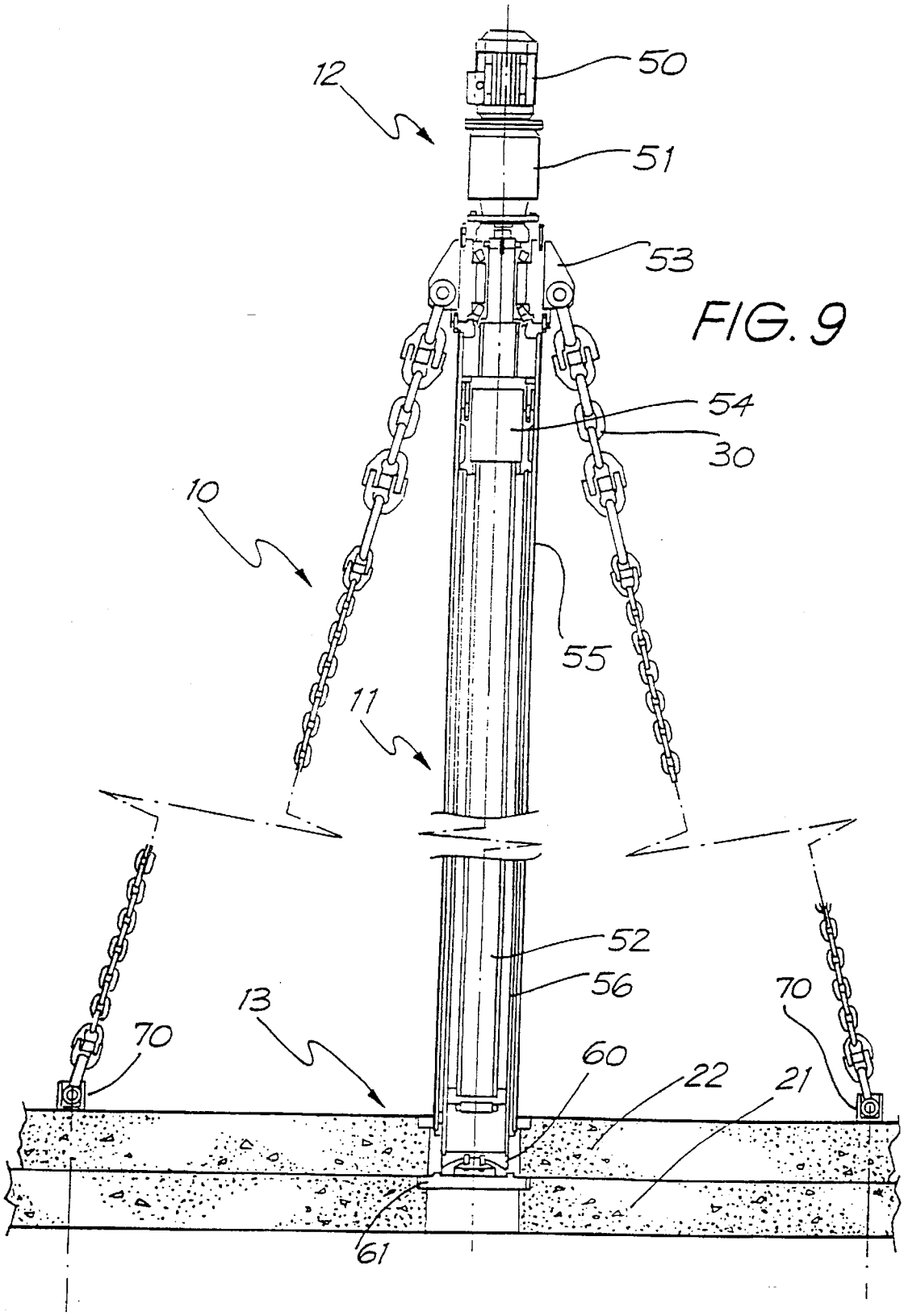
FIG. 9 shows a partial sectional view of the prop means of FIGS. 7–8.

FIG. 9 shows a particularly preferred embodiment of prop means 10. The prop means shown in FIG. 9 is extendible by means of motor 50 positioned on top of prop means 10. Motor 50 is connected to gearbox 51 such that when motor 50 is engaged, elongate screw 52 is rotated through gearbox 51. A thrust bearing 53 ensures appropriate axial alignment of screw 52 and gearbox 51.

In this case, head portion 11 comprises an outer female member 55 and foot portion 13 comprises an inner male member 56 slidably receivable within outer female member 55. Such a grouping of inner and outer members helps to resist bending or buckling of prop means 10. The inner male member 56 is threadably connected to screw 52 by means of threaded sleeve 54 such that inner male member 56 moves relative to outer female member 55 in response to rotation of screw 52. Extension or retraction of prop means 10 is accomplished by appropriate rotation of screw 52. For example, if screw 52 is rotated in a clockwise direction, screw 52 will tend to rotate upwardly through threaded sleeve 54 extending head portion 12 away from foot portion 13 and lifting slab 22. Conversely, if ball screw 52 is rotated in an anti-clockwise direction, the screw 52 will tend to rotate downwardly through threaded sleeve 54 and head portion 12 will move toward foot portion 13 lowering slab 22.

The torque from motor 50 imparted to the prop means 10 may be resolved in several different ways. For example, the inner male member 56 may be "keyed" to the outer female member 55 by means of a longitudinal rib running along the interior surface of female member 55. The inner male member 56 may be provided with a slot or recess for receiving this rib. Such a "keying" of the inner male member 56 to the outer female member 55 prevents relative rotation therebetween and since foot portion 13 of the prop means 10 is anchored to a support slab, the prop means as a whole cannot rotate.

As an alternative to the above, the outer female member may be "keyed" to the slab being lifted. For example, a longitudinal rib may be formed on the exterior surface of the female member 55. The respective aperture in the slab 22 to be lifted may comprise a recess of slot sized to receive such a rib. Rotation of the outer female member 55 relative to either the slab 22 or the inner male member 56 is thus prevented.

When slab 22 is in its correct position, as shown in FIG. 8, the head portion of prop means 10 above slab 22 may be held such that rotation of screw 52 retracts the prop means 10 and detaches foot portion 13 from floor slab 21 and raises it by one floor level to engage floor slab 22 ready for lifting of the next floor slab.

As shown in FIG. 9, it is preferred that the foot portion 13 includes a cup bearing 60 resting a plate 61. The cup bearing 60 comprises a domed portion received in a complimentary dished portion allowing relative movement therebetween. This cup bearing 60 fits within a recess formed in plate 61 which covers the respective aperture formed in the first floor slab 21. Such a plate 61 ensures reliable engagement of foot portion 13 on slab 21. By incorporating a cup bearing 60 in foot portion 13, the prop means 10 may tilt slightly from the vertical to allow for any difference between the lengths of suspension means 30 on either side of prop means 10 due to differences in the manufacturing tolerances, slight stretching or expansion of the joints in chains 30 etc. Such tilting of the prop means may cause foot portion 13 to slide out of engagement with slab 21.

Further, while it is preferred that the load to be carried by each of the suspension means is equal, the various chains slings etc. extending from the head portion of the prop means may be subjected to unequal load. For example, if the prop means is positioned off-centre of an area to be lifted, the chains or slings on one side of the prop means will be required to lift a larger area of slab and be subjected to a greater load than those on the other side of the prop means.

The chains and slings may be cut to different lengths to compensate for the off-centre position of the prop means thereby equalising the tension exerted on all the chains. Such a process is, however, time consuming and not guaranteed of success. If the chains are not precisely measured to compensate for the positioning of the prop means, lifting of the prop may generate different tensions in the various chains and slings which will tend to pull the prop means to one side.

By incorporating a cup bearing in the foot portion of the prop means, the prop means may tilt in response to the various tensions exerted by the chains or slings to thereby equalise the tensions in those chains. Such tiling and equalising of the chain tensions ensures that the full load of the slab is transmitted down through the axis of the prop means to the foot portion and supporting slab.

By incorporating a cup bearing resting in plate 61, a reliable engagement of foot portion 13 with slab 21 is provided.

It is also proposed, according to the present invention that the plurality prop means 10 spaced about the slab area may be lifted according to any desired profile or configuration. For example, if a newly poured slab is easily separated from its support slab, the prop means may all extend in unison, thereby avoiding any tilting, warping or twisting of the slab. Alternatively, if it is difficult to separate a newly poured slab from its support slab, a selected number of prop means may be extended to separate a portion of the newly poured slab from its support slab to "peel" the newly poured slab from the lower slab.

Another advantage which arises from the present invention is correct alignment of the back propping to support a lifted slab. As shown in FIGS. 7–9, each prop means is connected to the slab at connection points 70. These connection points preferably comprise bolts extending through the width of slab 22. Such connection points 70 serve as handy alignment markers for back propping of a lifted slab. To explain, once a slab is lifted into position, an operator merely positions the back props at those points where the connection bolts are exposed under slab 22. A similar exposed connection point on the lower slab ensures appropriate vertical alignment of the back props or supports 40, 41.

To assist with correct vertical alignment of the slab being lifted 22 and previous slabs 20, 21 a guide means may extend between the various slabs.

One particularly preferred form of guide means comprises at least two guide arms extending diagonally between slabs 22 and 21 along two right angled edges. The guide arms are preferably extendible and are operatively connected to an alignment means, such as a laser plumb-bob.

The guide means operates as follows. The laser alignment means is connected to the slab to be lifted and is firstly calibrated with an appropriate sensor point on the ground floor slab. The slab is then lifted with guide arms along both edges normally extending in unison with the prop means. Extension or retraction of one of the guide arms only moves the slab being lifted relative to the slab below, i.e., retraction or extension of a guide arm moves the slab in a direction parallel to that guide arm. Since at least two right angled guide arms are provided, the slab may be moved in any direction relative to the slab below.

By operatively connecting the guide arms to the adjustment means, operation of the guide means is dependent on the position of the laser on the sensor point. If the laser moves outside the connect point, a guide arm is extended or retracted slightly to bring the laser back to its correct position thereby providing correct alignment between the slabs.

INDUSTRIAL APPLICABILITY

The present invention provides an inventive method and apparatus for constructing a multi-storey building. The inventive method and apparatus lifts an entire floor slab or sections of a floor slab into position without the need for exterior lifting apparatus such as cranes. There is also no need for repositioning of scaffolding, formwork etc. from one floor to the next since the inventive prop means climb the building as it is constructed ready to lift the next floor slab.

While the present inventive apparatus may be used for any building with at least ground and first floor levels, it is envisaged that the inventive method and apparatus will provide the greatest benefits in large multi-storey buildings with approximately six or more floors.

From the foregoing, it should be apparent that the invention encompasses an advantageous advance in the art, or at least a commercial alternative to the prior art. Further, it should be clear that the invention may be embodied in other specific forms without departing from the spirit or scope or the essential characteristics thereof. The present embodiments are, therefore, to be considered in all respects as illustrative and not restrictive.

I claim:

1. A method for constructing a multi-storey building comprising the steps of:

i) providing a plurality of extendible props having a head portion, a foot portion and an extendible portion stretching therebetween;

ii) providing a plurality of floor or ceiling slabs with a plurality of apertures therethrough spread about the slab area;

iii) connecting a first said slab to a plurality of said extendible props positioned in respective apertures, each head portion being positioned above and connected to said first slab, said extendible portion of each of said props projecting downwardly through respective apertures whereby each said foot portion is supported by a second said slab below said first slab;

iv) extending said extendible portion of said props to lift said first slab to a desired position;

v) supporting said first slab at said desired position by a support member;

vi) retracting said extendible portion of each extended prop through its respective aperture to detach said foot portion from said second slab; and vii) engaging said foot portion with said first slab to raise a subsequent slab.

2. A method for constructing a multi-storey building according to claim 1 wherein at least steps (ii) to (iv) are repeated according to the number of storeys required in the building.

3. A method for constructing a multi-storey building according to claim 1 wherein said second slab is directly below said first slab, said first slab being formed directly on top of said second slab.

4. A method for constructing a multi-storey building according to claim 3 wherein a number of said extendible props are located adjacent an edge of said first slab and are extended prior to a remaining number of said extendible props being extended in order to peel said first slab away from said second slab.

5. A method for constructing a multi-storey building according to claims 1 wherein said head portion is connected to said first slab by at least one suspension member.

6. A method of constructing a multi-storey building according to claim 5 wherein said suspension member comprises chains or slings extending from said head portion to a position on said first slab spaced from the vertical axis of the respective prop.

7. A method for constructing a multi-storey building according to claim 1 wherein said plurality of props are extended in unison.

8. A method for constructing a multi-storey building according to claim 1 wherein said support member for holding said first slab in the desired position is a back prop arranged between said first and second slabs.

9. A method for constructing a multi-storey building according to claim 1 wherein said support member for holding said first slab in the desired position is a support member of the building.

10. A method for constructing a multi-storey building according to claim 1 wherein at least said head portion of said props is held stationary relative to said first slab prior to retraction of said extendible portion.

11. A method for constructing a multi-storey building according to claim 1 wherein after said first slab is lifted to and supported at a desired position, slab edge formwork elements connected to said props is raised by one slab thickness in readiness to form said subsequent slab.

12. A method as claimed in claim 9, wherein said support member comprises a column.

13. A method as claimed in claim 9, wherein said support member comprises a wall.

14. A method for constructing a multi-storey building comprising the steps of:

i) providing a plurality of extendible props having a head portion, a foot portion and an extendible portion stretching therebetween;

ii) providing an $n^{th}$ floor slab with a plurality of apertures therethrough spread about the slab area, said $n^{th}$ floor slab formed on an $(n-1)^{th}$ floor slab, n being the number of the floor level under construction;

iii) connecting said $n^{th}$ floor slab with said plurality of extendible props positioned in respective apertures, each head portion being positioned above and connected to said $n^{th}$ floor slab, said extendible portion of each of said props projecting downwardly through respective apertures where each said foot portion is supported by said $(n-1)^{th}$ slab below said $n^{th}$ floor slab;

iv) extending said extendible portion of said props to lift said $n^{th}$ floor slab from said $(n-1)^{th}$ floor slab to a desired position;

v) supporting said $n^{th}$ floor slab at said desired position by a support member;

vi) retracting said extendible portion of each extended prop through its respective aperture to detach said foot portion from said $(n-1)^{th}$ slab below said $n^{th}$ floor slab.

15. A method for constructing a multi-storey building according to claim 14 wherein said support member for supporting said $n^{th}$ floor slab at said desired position is a back prop arranged between said $n^{th}$ and said $(n-1)^{th}$ floor slabs.

16. A method for constructing a multi-storey building according to claim 14 wherein said support member for supporting said $n^{th}$ floor slab at said desired position is a support member of the building.

* * * * *